United States Patent [19]

Cremonesi

[11] Patent Number: 4,947,899

[45] Date of Patent: Aug. 14, 1990

[54] HOOK STRUCTURE FOR NEGATIVE DOBBY LOOMS

[75] Inventor: Gianluigi Cremonesi, Ponte Nossa, Italy

[73] Assignee: Fimtessile Fabbrica Italiana Macchinario Tessile S.p.A., Ponte Nossa, Italy

[21] Appl. No.: 853,955

[22] Filed: Apr. 21, 1986

[30] Foreign Application Priority Data

Apr. 24, 1985 [IT] Italy ..... 20488 A/85

[51] Int. Cl.[5] ..... D03C 1/06

[52] U.S. Cl. ..... 139/71

[58] Field of Search ..... 139/68, 71, 72

[56] References Cited

U.S. PATENT DOCUMENTS

| | | | |
|---|---|---|---|
| 3,459,236 | 8/1969 | Faure | 139/71 |
| 4,305,432 | 12/1981 | Schwarz | 139/71 |
| 4,465,108 | 8/1984 | Epis | 139/71 |
| 4,687,028 | 8/1987 | Cremonesi | 139/71 |

FOREIGN PATENT DOCUMENTS

| | | | |
|---|---|---|---|
| 2544649 | 4/1977 | Fed. Rep. of Germany | 139/71 |

*Primary Examiner*—Andrew M. Falik

*Attorney, Agent, or Firm*—Stevens, Davis, Miller & Mosher

[57] ABSTRACT

In a negative dobby for forming the warp shed in weaving looms, impacts and friction are reduced and consequently vibrations and noise-thereby improving the stability of the heald frames-by suitably shaping the rear end (14) of the hooks ( 7, 8), so as to facilitate the oscillation thereof only when they engage with the crooks (9, 10) which cooperate with the hooks.

3 Claims, 2 Drawing Sheets

HOOK STRUCTURE FOR NEGATIVE DOBBY LOOMS

BACKGROUND OF THE INVENTION

The present invention concerns improvements in negative dobbies for forming the warp shed in weaving looms. The object of these improvements is to reduce the stresses, to damp vibrations and deaden noises and to improve the working precision of these machines, so as to allow a more efficient and rational use thereof in combination with looms working at high and very high speeds, as those already in use and now increasingly expanding.

In technique there are known to be negative dobbies for looms, wherein the engagement between the hooks pivoted on the rockers and the respective crooks, takes place after such crooks—already positioned for engagement—have been caused to oscillate by the hooks. In the known arrangements of this type, the engagement between the crooks and the hooks can be obtained only after said hooks have performed a short idle stroke, shifting beyond said crooks so as to take up a position of positive engagement. It is easy to understand the importance of limiting as far as possible the extent of said idle stroke, in order to reduce impact when engagement takes place, especially if the dobby—having to adapt itself to the speeds of faster looms—has to work at high speeds, thereby increasing the accelerations of its moving component parts. It is equally important to prevent the hooks from hitting too forcefully against the crooks, when touching them to cause their oscillation allowing subsequent mutual engagement.

Reducing all these impacts, which follow at very frequent intervals and close distances, means in fact reducing the vibrations in the machine and consequently the noises and the wear of its parts; an increased working precision is thereby obtained, with an improved weaving performance. Finally, the control of the machine on the heald frames results greatly improved, determining an increased stability thereof, with advantageous results as far as quality of the production.

SUMMARY OF THE INVENTION

The present invention intends to reach this object by supplying a negative dobby—of the type wherein the rocking movements imparted on the rockers, which control the shifting of the heald frames, by a pair of movable cross members, are controlled by hooks pivoted to the ends of said rockers and by crooks cooperating with said hooks and operated by the means reading the pattern of the fabric to be woven—characterized in that the rear end of said hooks, onto which press the movable cross members, is shaped so as to facilitate their oscillation only when they engage with the crooks.

According to the invention, the rear end of the hooks is suitably shaped, so as to have its lower part flat and its upper part convex, with simple curvature, for instance cylindrical.

BRIEF DESCRIPTION OF THE DRAWINGS

The invention is described hereinafter, by mere way of non-limiting example, with reference to the accompanying drawings, which show a preferred embodiment thereof and in which:

FIG. 1 is a general schematic view of the negative dobby according to the invention; of which

DESCRIPTION OF THE PREFERRED EMBODIMENT

As known, dobbies are mechanisms for forming the warp shed in weaving looms, starting from a prearranged pattern of the fabric to be woven, which is coded onto a punched tape or onto a spiked roller or like and the reading of which allows to operate rocking levers which control the movements of the heald frames.

The conventional dobbies include positive dobbies, wherein the heald frames are positively controlled in their upward and downward movements, overcoming the reaction of the stretched warp yarns, and negative dobbies, wherein the heald frames are controlled only in one direction, in opposition to return spring means. The present invention concerns, as already said, a dobby of the second type.

Figure 1:
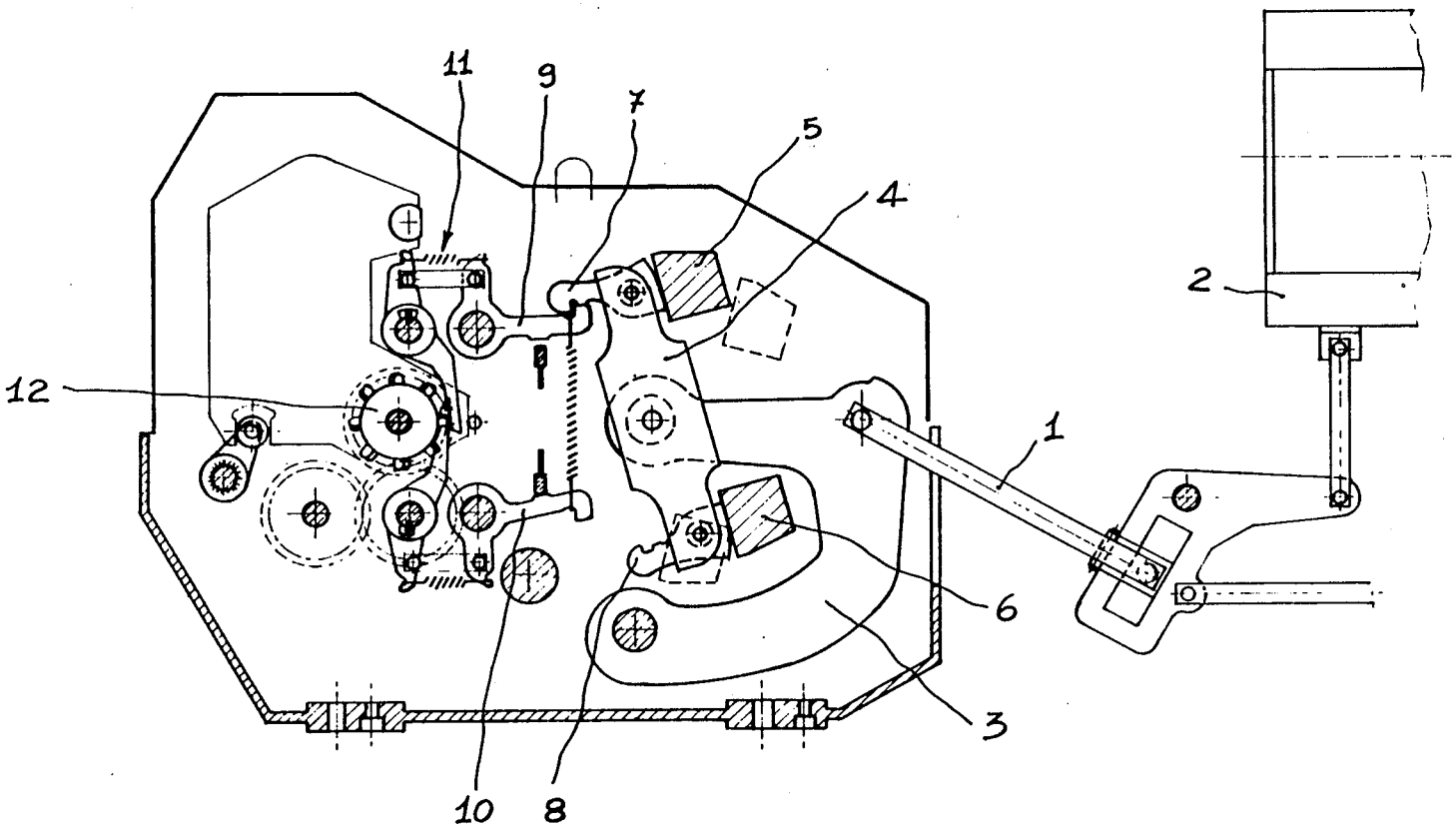

FIG. 1 of the accompanying drawings is a schematic view of the negative dobby according to the invention—showing the control of a single heald frame—wherein a drawrod 1 for shifting the heald frame 2 is pivotally connected, at its controlled end, to a rocking lever 3 of the rocker 4. Said rocker 4 is rocked in known manner by two movable cross members 5 and 6, connected to a control mechanism (not shown), and carries hooks 7 and 8 pivoted to its ends, said cross members 5 and 6 pressing onto the rear end of said hooks 7 and 8, which are designed to cooperate with respective crooks 9 and 10 controlled, by way of a spring and lever system 11, by a spiked roller 12 onto which is coded the pattern of the fabric to be woven.

According to the controls received from the spiked roller 12, the crooks 9 and 10 either release or engage the hooks 7 and 8, so as to operate the rocker 4 and obtain, through the movements imparted on the heald frame 2 by the drawrod 1, the forming of the warp shed.

Figure 2:
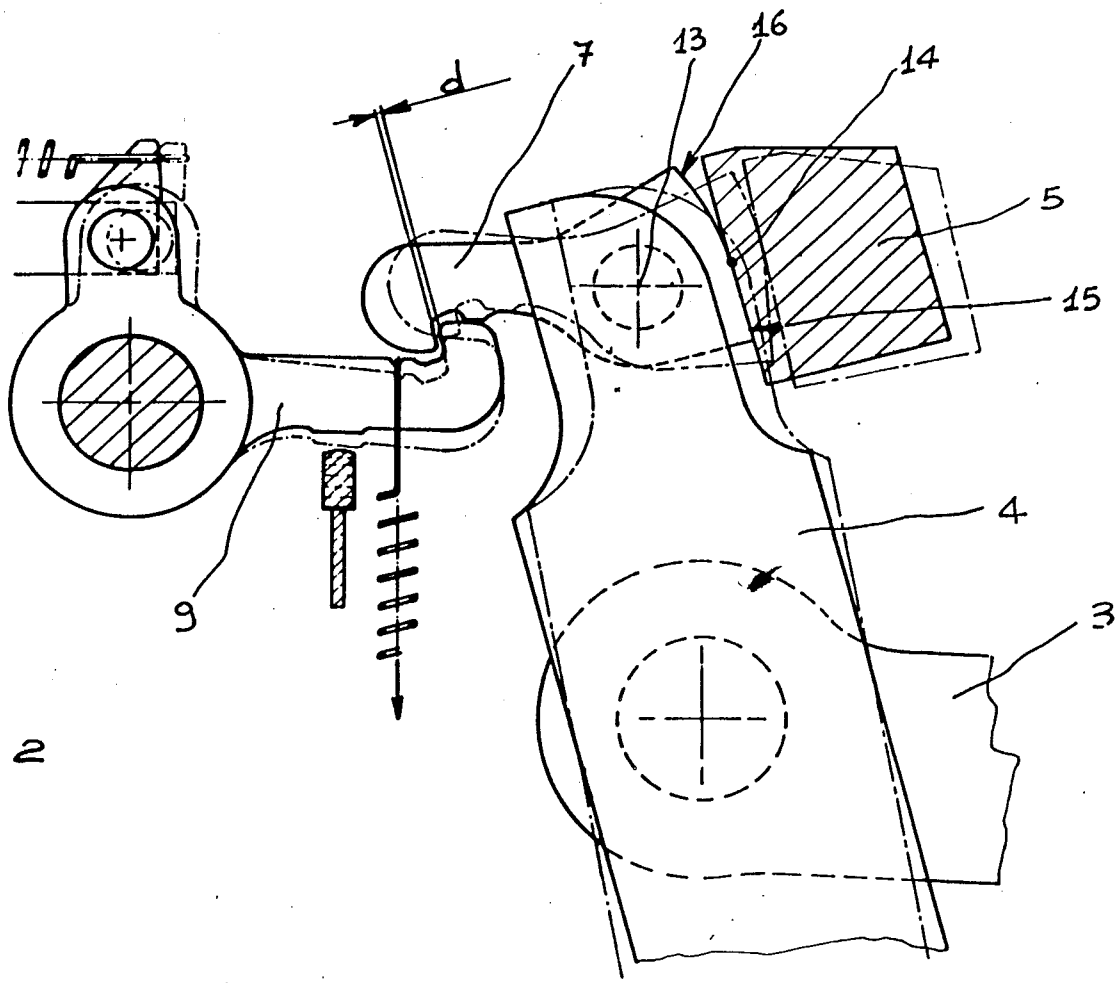
FIG. 2 shows in detail the improvements.

According to the invention, the hooks 7 and 8 of the rocker 4, which are pivoted on said rocker in known manner, have their rear end onto which press the movable cross members 5 and 6—which is always flat in the conventional machines—suitably shaped for the purposes explained hereinafter, as clearly shown in FIG. 2 with reference to the hook 7. In the embodiment illustrated in this figure, the rear end 14 of the hook 7 is flat in its lower part 15 and convex in its upper part 16. The convex surface 16 is a surface with simple curvature and it can be, for instance, a cylindrical surface portion with horizontal axis, suitably radiused to the flat surface 15.

In operation (see FIG. 2), when the cross member 5, pressing onto the rear end 14 of the hook 7, oscillates the rocker 4 to lead said hook 7 into engagement with the crook 9, this latter is already positioned for engagement (continuous lines of FIG. 2), having been set in this position by the spring and lever system 11 controlled by the spiked roller 12. The hook 7 (positioned as in continuous lines of FIG. 2, but more backward to the right) thus hits the front upper part of the crook 9 with its front lower part. The crook 9 then oscillates, in known manner, towards the position in dashed lines of FIG. 2, so as to let by the hook 7—which moves beyond it—and subsequently engage therewith when moving backward.

According to the invention, also the hook 7 is now apt to perform an oscillation (not allowed in the conventional dobbies), thanks to the curved profile of the upper part 16 of its rear end 14, thereby greatly facilitating its movement beyond the crook 9. This notably reduces impact between the hook and the crook, when engaging, as well as friction between their surfaces, but above all it allows to notably limit the idle stroke d which the hook 7 has to perform beyond the line of engagement with the crook 9, without prejudicing the positive engagement between said elements 7 and 9. This is obtained thanks to the fact that the position of the hook 7 at the end of said stroke—in spite of the oscillation of said hook being limited—is such as to fully favour its reliable engagement with the crook 9, as soon as the hook moves backward (towards the right in the drawing).

As already said, the characteristics of reducing impacts and friction, and consequently vibrations and noise, and of limiting the idle stroke of the hooks—achieved with the invention—contribute in making the heretofore described dobby far more suitable, than the conventional dobbies, for equipping fast looms with very satisfactory results.

It is understood that there could be other practical embodiments of the invention, differing from the one illustrated. In particular, one could consider as falling within the scope of the present invention a dobby wherein, the rear end of the hooks—onto which press the movable cross members to cause the oscillation of the rockers—instead of being suitably shaped, is formed flat, while the surfaces of said cross members pressing onto the hooks are instead suitably shaped. In this case, such surfaces would preferably be flat on their lower part and concave on their upper part. The results obtained, namely the possibility for the hooks to oscillate when engaging the crooks, would obviously be the same.

I claim:

1. In a negative dobby for forming the warp shed in weaving looms comprising movable heald frames, pivotal rockers interconnected to said heald frames, a pair of movable cross members to impart rocking movements to the rockers, which control the movement of the heald frames, hooks having pivot points remote from ends thereof to which movement is imparted by said cross members on the ends of said rockers, crooks cooperating with said hooks and means reading the pattern of the fabric to be woven operating said crooks, the improvement wherein the rear end of said hooks, onto which press the movable cross members, is shaped to facilitate oscillation of said hooks about said pivot point only when said hooks engage with said crooks.

2. The negative dobby as in claim 1, wherein the rear end of the hooks is shaped so as to have its lower part flat and its upper part convex, with simple curvature.

3. The negative dobby as in claim 2, wherein the upper part of the rear end of the hooks is a cylindrical surface portion.

* * * * *